US011628447B2

(12) United States Patent
Maynard

(10) Patent No.: US 11,628,447 B2
(45) Date of Patent: Apr. 18, 2023

(54) PLASTIC GRANULATOR STATIONARY CUTTING SEGMENT

(71) Applicant: SIZE REDUCTION SPECIALISTS CORP., East Lansing, MI (US)

(72) Inventor: Donald Maynard, East Lansing, MI (US)

(73) Assignee: SIZE REDUCTION SPECIALISTS CORP., East Lansing, MI (US)

( * ) Notice: Subject to any disclaimer, the term of this patent is extended or adjusted under 35 U.S.C. 154(b) by 116 days.

(21) Appl. No.: 16/852,895

(22) Filed: Apr. 20, 2020

(65) Prior Publication Data

US 2020/0246802 A1 Aug. 6, 2020

Related U.S. Application Data

(63) Continuation-in-part of application No. 15/417,420, filed on Jan. 27, 2017, now abandoned.

(60) Provisional application No. 62/287,634, filed on Jan. 27, 2016.

(51) Int. Cl.

| | |
|---|---|
| ***B02C 18/18*** | (2006.01) |
| ***B02C 18/00*** | (2006.01) |
| ***B02C 18/14*** | (2006.01) |

(52) U.S. Cl.

CPC ..... *B02C 18/18* (2013.01); *B02C 18/0084* (2013.01); *B02C 2018/188* (2013.01)

(58) Field of Classification Search

CPC ... B02C 18/18; B02C 18/0084; B02C 18/148; B02C 18/0092; B02C 2018/188

See application file for complete search history.

(56) References Cited

U.S. PATENT DOCUMENTS

| | | | | |
|---|---|---|---|---|
| 2,336,069 A * | 12/1943 | Chase | B01D 33/466 | 210/174 |
| 3,584,743 A * | 6/1971 | Dinges | B02C 18/0092 | 210/174 |
| 3,873,035 A * | 3/1975 | Benson | B02C 18/0084 | 241/100 |
| 6,450,427 B1 | 9/2002 | Maynard | | |

FOREIGN PATENT DOCUMENTS

GB 571133 A 8/1945

* cited by examiner

*Primary Examiner* — Shelley M Self
*Assistant Examiner* — Mohammed S. Alawadi
(74) *Attorney, Agent, or Firm* — MaxGoLaw PLLC

(57) ABSTRACT

A plastic granulator apparatus stationary cutting segment includes a segment rail having multiple arcuate spaced teeth. Each tooth of the plurality of arcuate spaced teeth has a tooth surface and is spaced to be complementary to a rotary cutter segments as a rotary cutter is rotated. The segment rail is adapted to be mounted to a granulator housing. The rail segment has a shoulder with a shoulder surface, the shoulder is adjacent to each of a set of arcuate spaced teeth. The shoulder has a shoulder surface height of between 0 and 10 mm, and a stepback distance of between 0 and 2 mm between the shoulder surface and the arcuate tooth surface. The shoulder and the arcuate tooth surface define an angle therebetween of 90° and 130°, and the shoulder surface defines an angle between 90° and 130°.

11 Claims, 7 Drawing Sheets

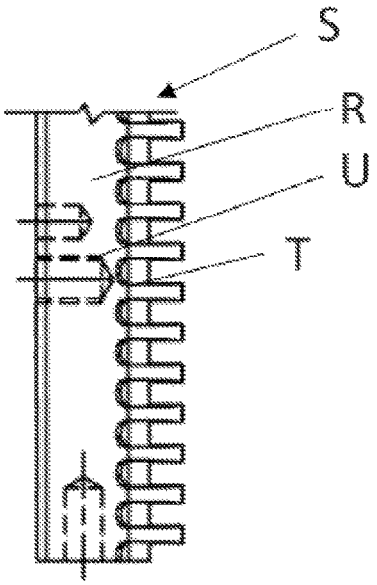
PRIOR ART FIG. 1A
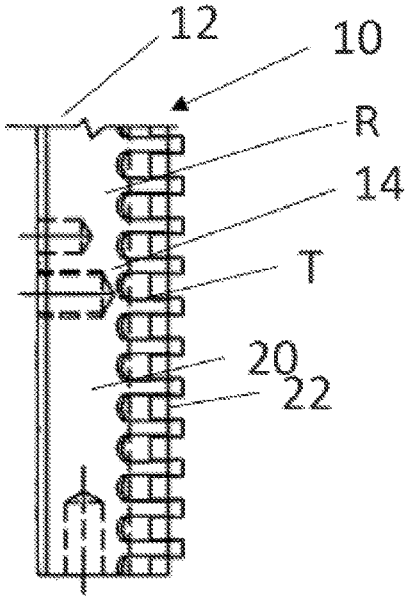
FIG. 2A
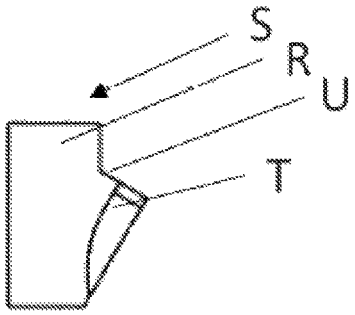
PRIOR ART FIG. 1B
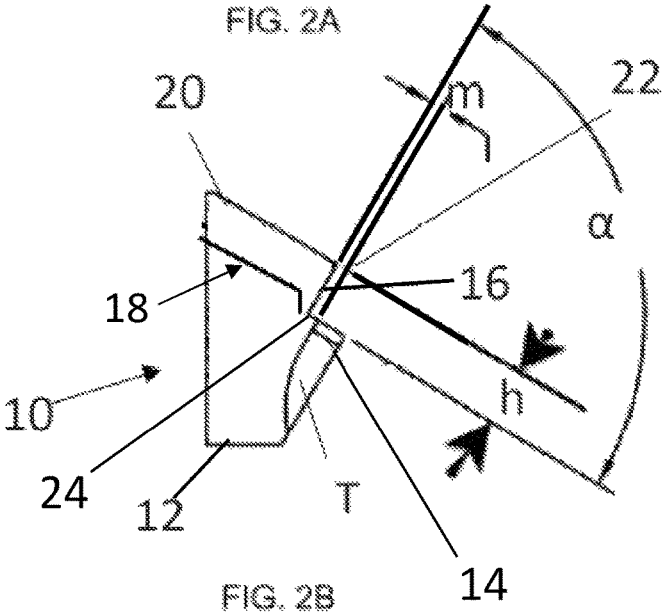
FIG. 2B

PLASTIC GRANULATOR STATIONARY CUTTING SEGMENT

RELATED APPLICATIONS

This application is a continuation-in-part of U.S. Ser. No. 15/417,420, filed Jan. 27, 2017; that in turn claims priority benefit of U.S. Provisional Application Ser. No. 62/287,634 filed Jan. 27, 2016; the contents of which are hereby incorporated by reference.

FIELD OF THE INVENTION

The present invention in general relates to the field of plastic granulators and in particular stationary cutter segments that increase throughput.

BACKGROUND OF THE INVENTION

Plastic granulators are used to cut over-sized pieces of plastic material produced during the manufacturing process of articles into pellet-sized material suitable for reuse as feedstock or recycle. A class of conventional granulators uses a rotary cutter to catch an elongated piece of plastic, such as a sprue, and scission the plastic against a stationary cutter segment to form a granule with dimensions defined by the rotary cutter blade width. Successive stages of such cutters can be incorporated into a granulator to achieve a desired granule size. U.S. Pat. No. 6,450,427 is exemplary of such granulators.

The throughput of such granulators is limited by oversized pieces of plastic. In this type of granulators a rotating cutter instead of cutting the sprue, causes the sprue to jump upward, in the process not only is a cutting opportunity lost, but the upward deflection of the sprue hampers additional material from dropping into a cutting section. As a result, the throughput of a cutter is less efficient.

Thus, there exists a need for a granulator that provides greater throughout of the material and minimizes jumping of the material in lieu of cutting the material.

SUMMARY OF THE INVENTION

A plastic granulator apparatus stationary cutting segment includes a segment rail having multiple arcuate spaced teeth. Each tooth of the plurality of arcuate spaced teeth has a tooth surface and is spaced to be complementary to a rotary cutter segment as a rotary cutter is rotated. The segment rail is adapted to be mounted to a granulator housing.

The rail segment has a shoulder with a shoulder surface, the shoulder is adjacent to each of arcuate spaced teeth. The shoulder has a shoulder surface height of between 0 and 10 mm, and a stepback distance of between 0 and 2 mm between the shoulder surface and the arcuate tooth surface. The shoulder and the tooth surface define an angle therebetween of 90° and 130°, and the shoulder surface having an angle between 90° and 130°.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

FIG. 1A is a prior art top view of a rail segment with a plurality of arcuate spaced teeth;

FIG. 1B is a prior art side view of an arcuate spaced tooth defining a tooth surface;

FIG. 2A is a top view of the arcuate spaced tooth defining a tooth surface and shoulder with a shoulder surface adjacent to the arcuate spaced tooth;

FIG. 2B is a side view of a rail segment having a shoulder with a shoulder surface, and each shoulder is adjacent to each plurality of arcuate spaced teeth;

DETAILED DESCRIPTION OF THE PREFERRED EMBODIMENTS

Figure 3:
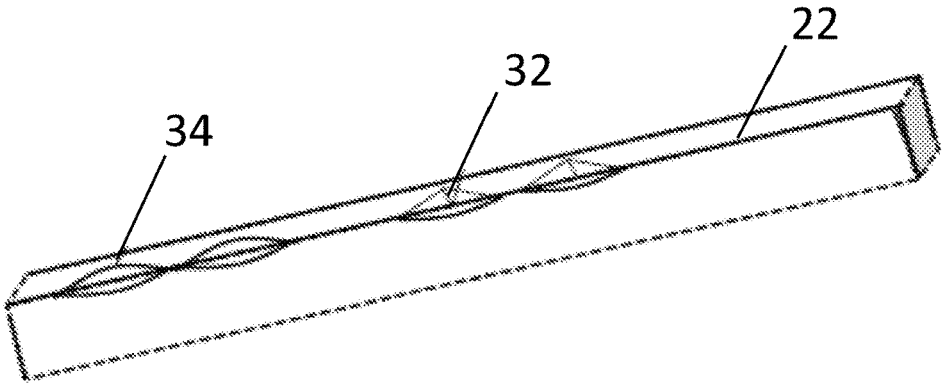
FIG. 3 is a perspective view of an edge of a hybrid shoulder portion showing both V-shaped grooves and scallops.

The present invention has utility as a plastic granulator stationary cutting segment. In particular, it has been surprisingly discovered that through the creation of a stationary cutter segment with an inventive shoulder, that the shoulder acts as an adjunct cutting surface as material is urged against the shoulder by a rotating cutter. An inventive stationary segment finds application in a granulator, as for example detailed in U.S. Pat. No. 6,450,427. In specific embodiments, a first coarse cutting stage that is feed material with highly variable dimensionality is observed to have a throughput increase of greater than 28% as compared to a conventional stationary cutter segment. The granulate exiting the second stage is uniformly divided, the granulator operates independent of a screen.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

With reference now to the drawing, the preferred embodiment of the vibrational roller is herein described. It should be noted that the articles "a", "an", and "the", as used in this specification, include plural referents unless the content clearly dictates otherwise.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

To better explain the innovation of the present invention, reference is made to prior art FIGS. 1A and 1B, that depict a top view and a side view of a conventional stationary cutter segment S, respectively. The segment S, has arcuate teeth T that are complementary to the blades of a rotary segment, such that blades rotate between adjacent teeth T and in the process shear any material caught therebetween. As best seen in FIG. 1B, a region R of the segment S above the teeth T defines an obtuse angle of about 135° with an upper surface U of the teeth T.

In contrast, to a conventional stationary segment of FIGS. 1A and 1B, an inventive plastic granulator stationary cutting segment is shown generally at 10 as in FIGS. 2A and 2B, where like reference numeral have the same meaning as ascribed to the use of the same reference numeral in the aforementioned drawings. The stationary segment 10 forms a rail 12 having arcuate spaced teeth T. Each tooth of the plurality of arcuate spaced teeth T has a tooth upper surface 14. Each tooth of the arcuate spaced teeth T remains complementary to a plurality of rotary cutter blades per the prior art (not shown). The segment 10 is adapted to be mounted to a granulator housing that also mounts the rotary shaft on which the rotary cutter is in turn mounted. Threaded fasteners are often used to secure a segment 10 to a granulator housing. The position of a segment 10 relative to a rotary cutter in a granulator is depicted, for example, in U.S. Pat. No. 6,450,427.

Figure 5A:
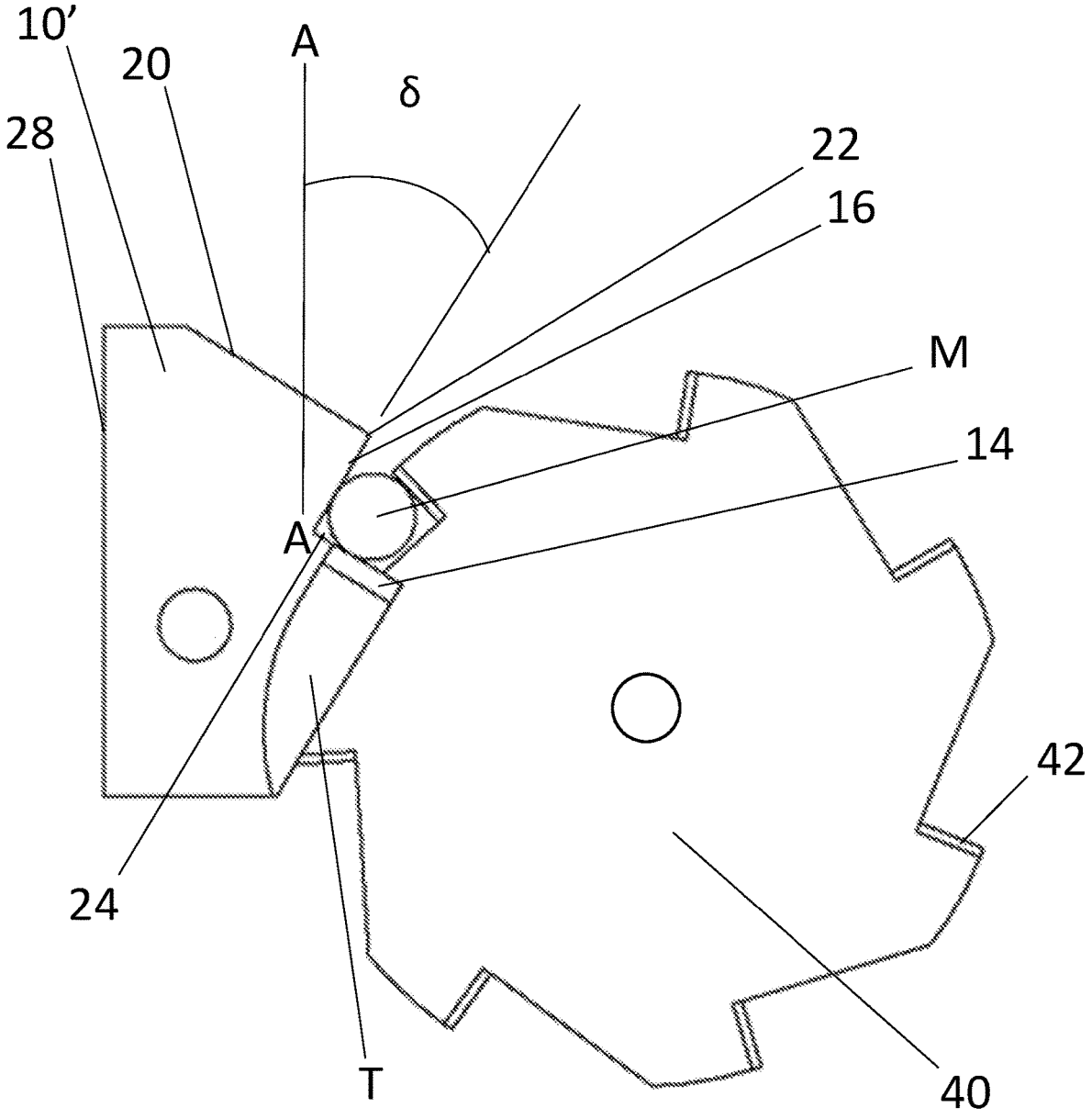
FIGS. 5A and 5B are side views of a rotary segment and the inventive stationary cutting segment and the definition of angles delta (δ) and lambda (λ), respectively.
Figure 5B:
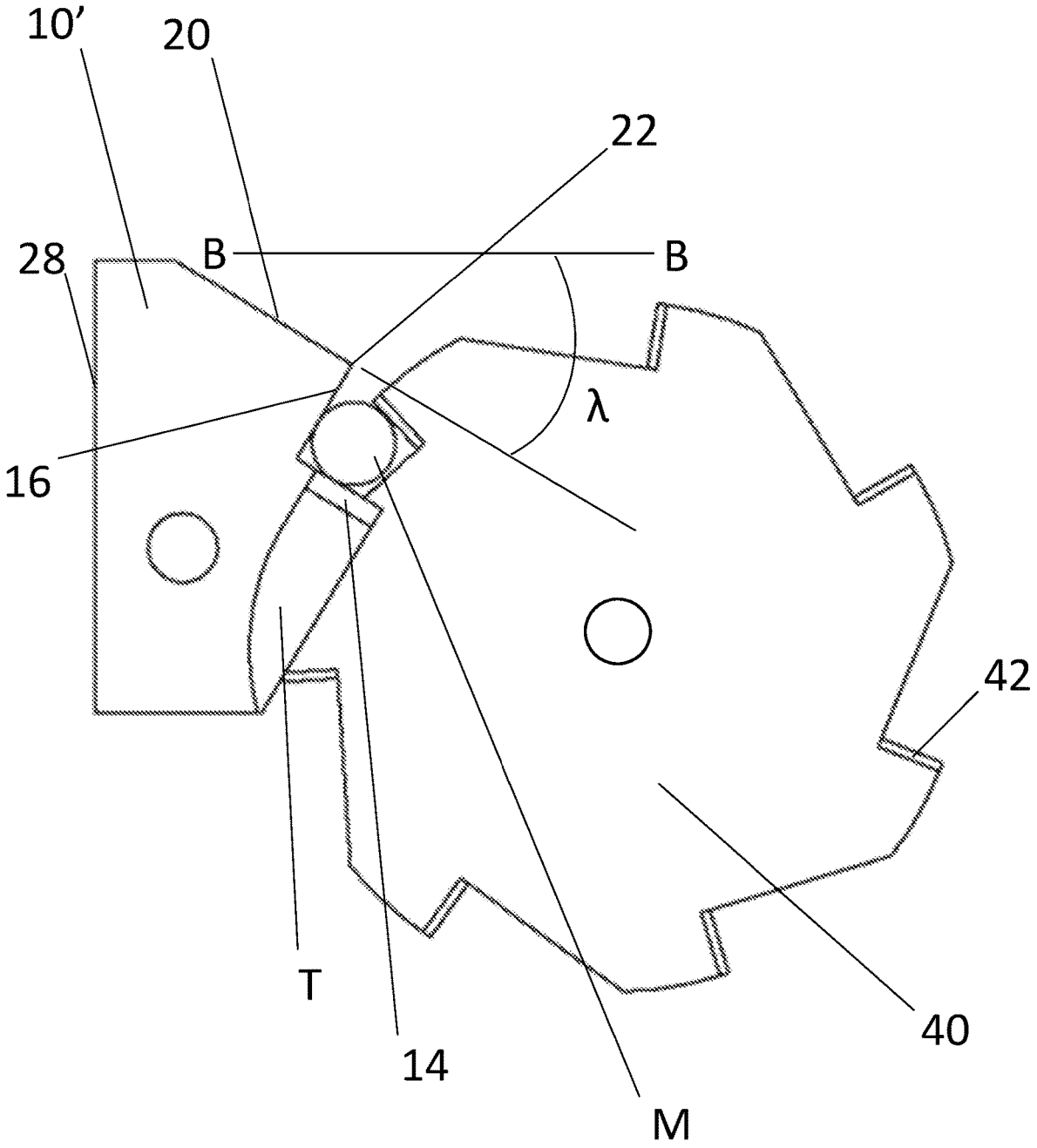

The rail segment 12 is machined to define a first shoulder surface 16 or a retrofit piece 18 adapted to fit the region R to define the first shoulder 16. The rail segment 12 is formed from metals such as steel or aluminum. Likewise, a retrofit piece 18 is formed of the same materials as rail segment 12. Whether integral or a piece 18 overlying a conventional segment S, the rail segment 12 has a first shoulder surface 16 and a second shoulder surface 20. The first shoulder surface 16 of the rail segment 12 has a height h of between 0 and 10 millimeters (mm), and a stepback 24 with stepback distance m of between 0 and 2 mm. In some inventive embodiments, the height h is between of 3 and 8 mm. The first shoulder surface 16 of the rail segment 12 and the tooth surface 14 having an angle a therebetween of 90° and 130° . In some inventive embodiments, the angle $\alpha$ is between of 90° and 110° . In some inventive embodiments, the angle a is between of 90° and 110° and the stepback 24 is between 1 and 2 mm. As best shown in FIG. 5A, the first shoulder surface 16 of the defines a rearward angle $\delta$ from the stepback 24 relative to the mounting base 28 of 30° as measured with respect to axis A-A. In some inventive embodiments, the angle $\delta$ is between of 20° and 40° . Without intending to be bound by a particular theory, it is believed that material that bridges above teeth T is sheared by being urged against the edge 22 defined by the intersection between first shoulder surface 16 and the second shoulder surface 20. As a result, in some inventive embodiments, a non-zero angle $\delta$ acts as to concentrate forces as the edge 22 to affect material shearing. In still other embodiments, the edge 22 is sharpened to promote shearing. In still other embodiments, as shown in FIG. 3, the edge 22 has one or more V-shaped grooves 32 or scallops 34 between adjacent teeth to promote pinning of sprue or other work piece to induce shearing. FIG. 5B illustrates an angle $\lambda$ relative to an axis B-B that defines the slope of second shoulder surface 20 that is shown at 30° . In some inventive embodiments, the angle $\lambda$ is between of 20° and 40° .

Figure 4A:
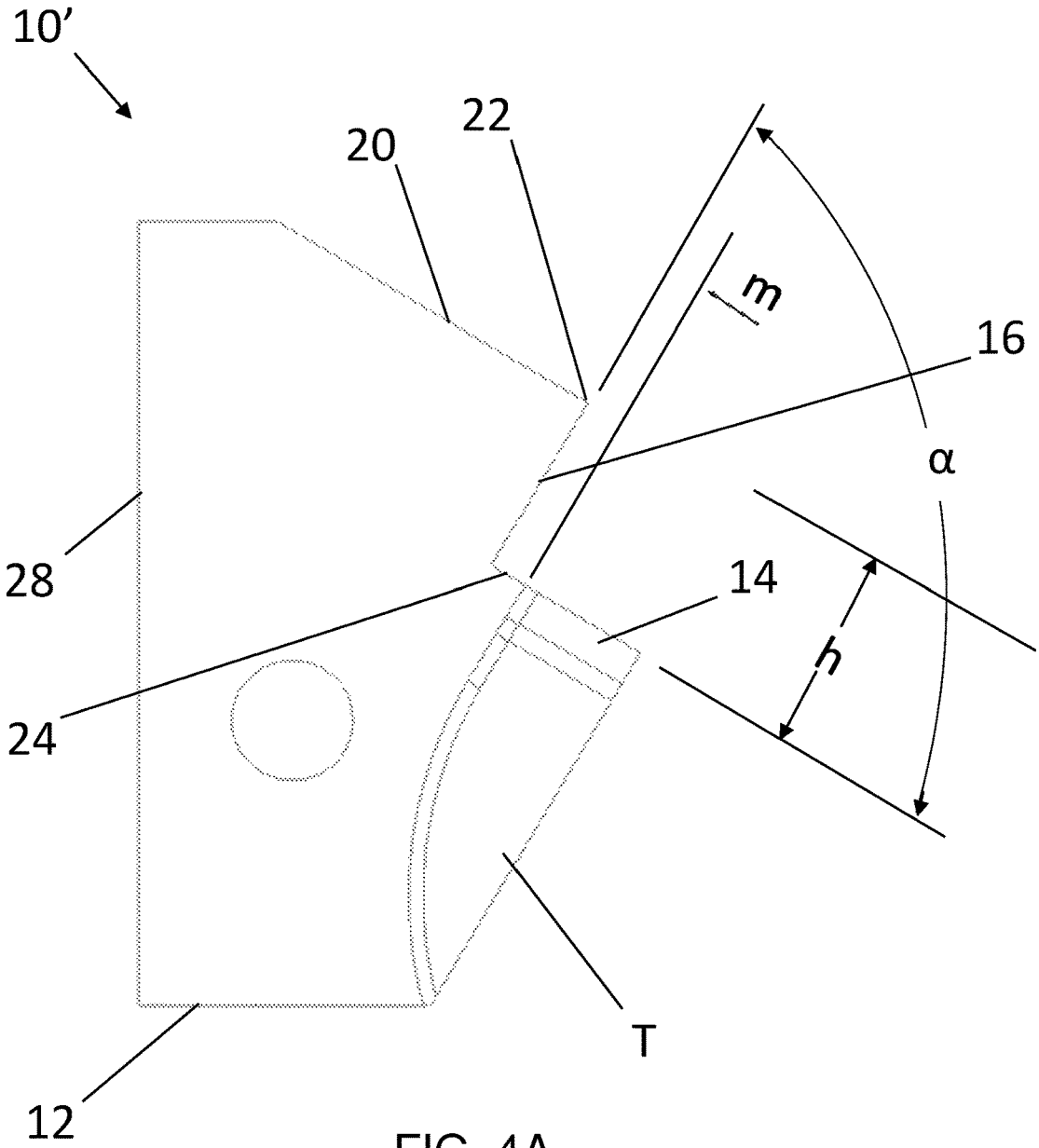
FIG. 4A is a side view of a rail segment in accordance with an embodiment of the invention.
Figure 4B:
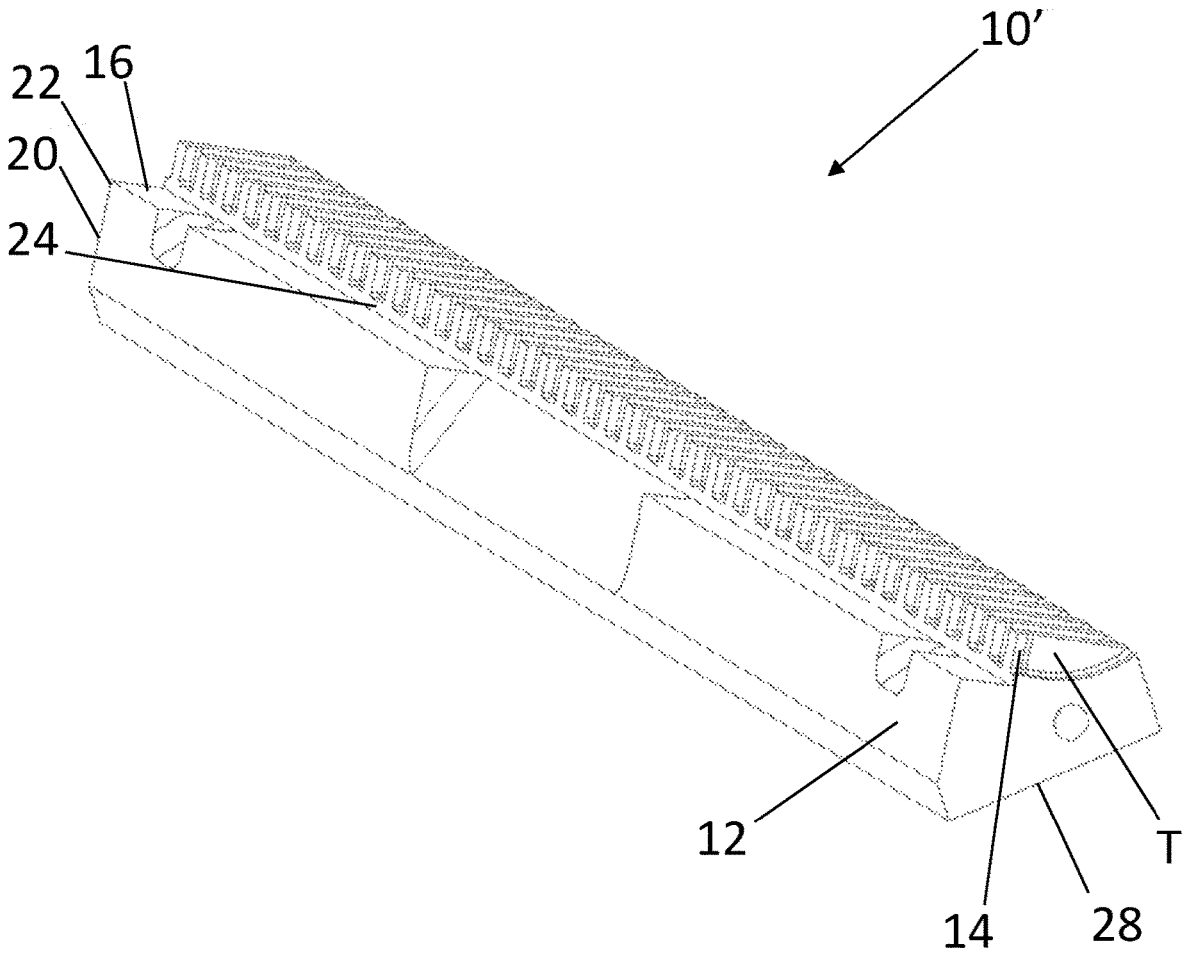
FIGS. 4B and 4C are perspective views of the rail segment of FIG. 4A.
Figure 4C:
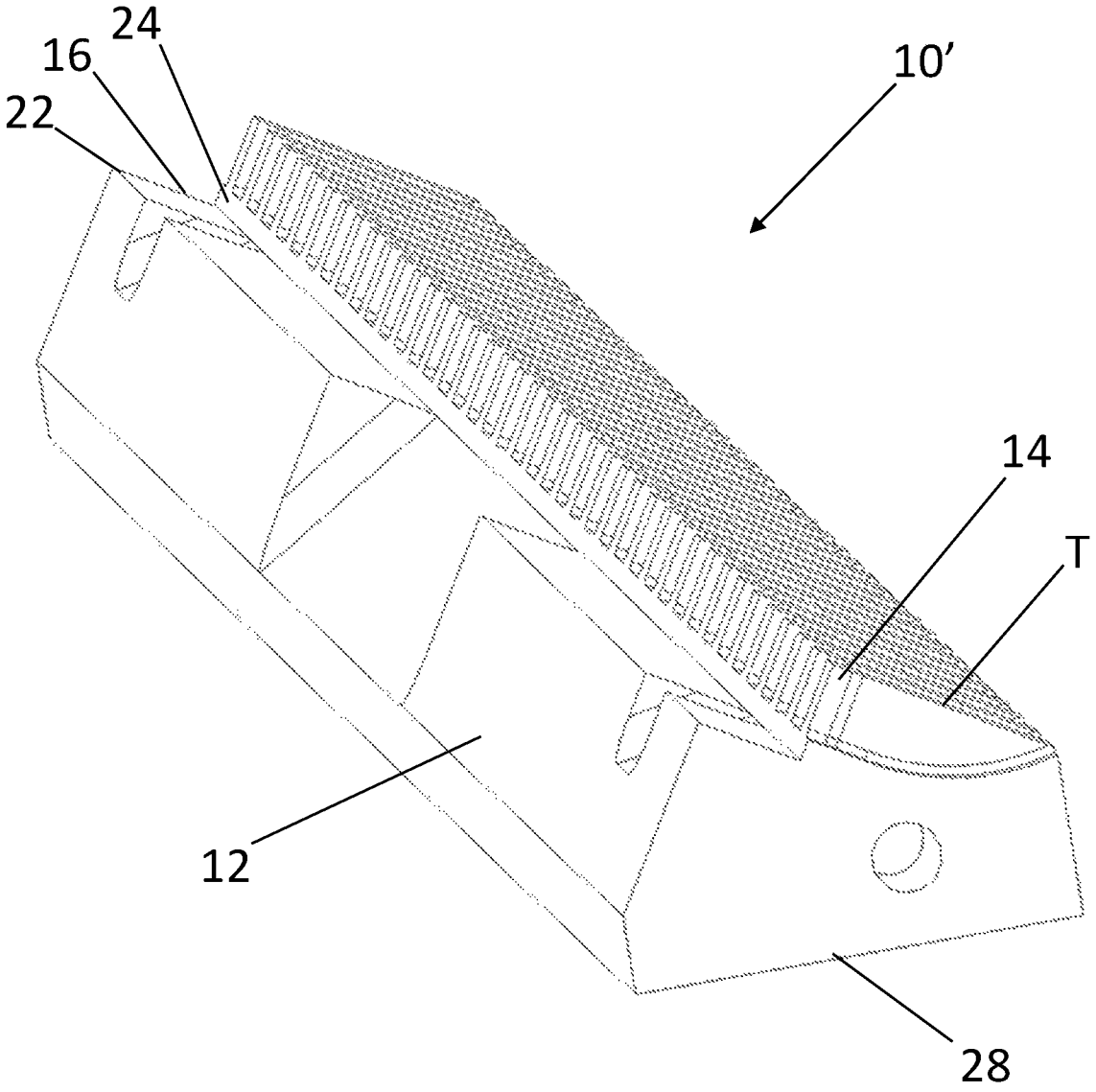

FIGS. 4A-4C are a series of views of an embodiment of the inventive plastic granulator stationary cutting segment 10'. In the side view of FIG. 4A the rail segment 12 has an angle $\alpha$ of 90° between the tooth surface 14 and the first shoulder surface 16 of the rail segment 12. Also visible in the perspective views 4A-4C is the stepback 24 with stepback distance m between tooth surface 14 and the first shoulder surface 16 of the rail segment 12.

FIGS. 5A and 5B illustrate the interaction of a rotary segment 40 and the stationary cutting segment 10'. A piece of material M is constrained by the first shoulder surface 16 of the stationary cutting segment 10' and stepback 24 so as not be pushed outward by the blades 42 of the rotary segment 40.

Figure 6:
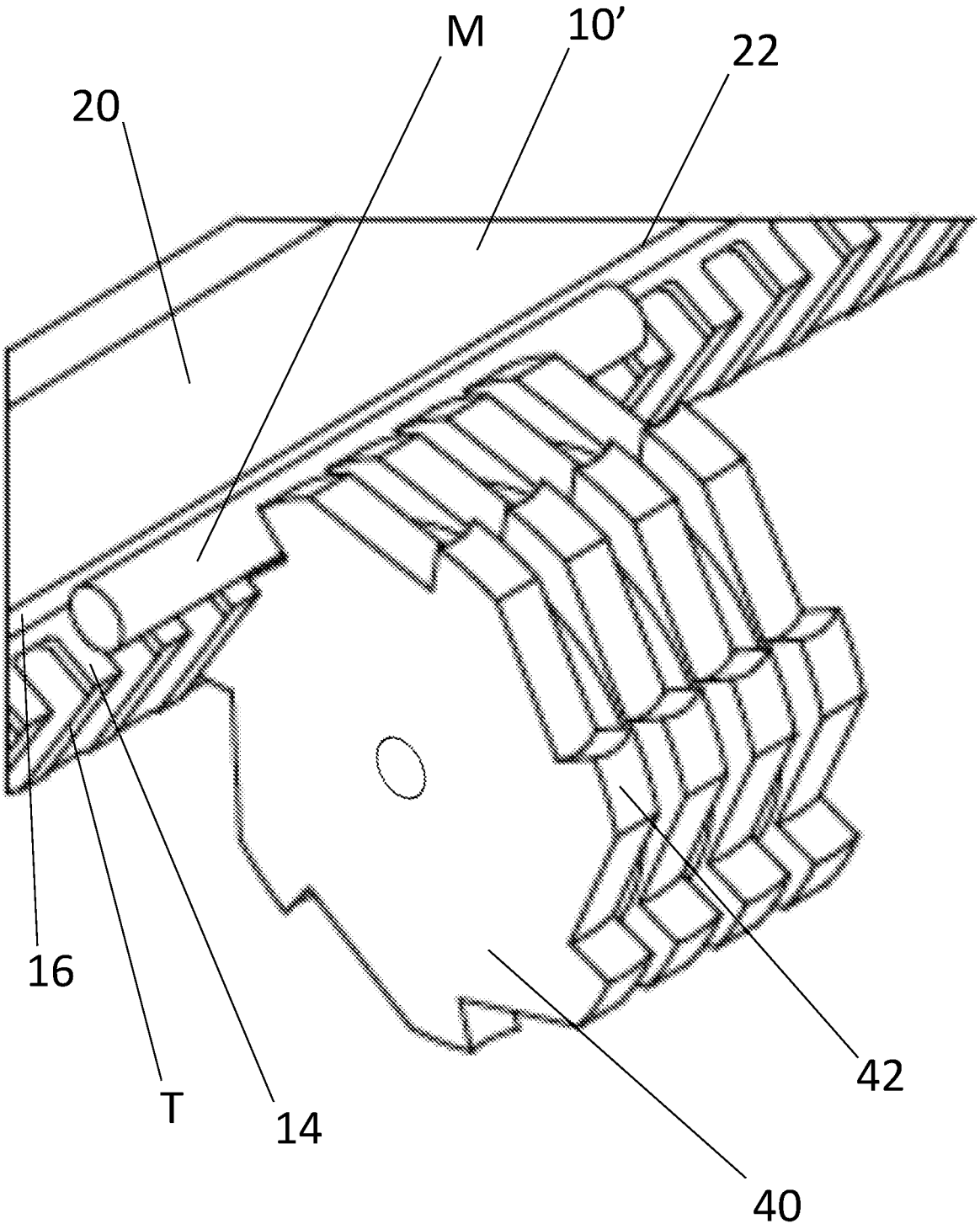
FIG. 6 is a partial perspective view that illustrates the interaction of a rotary segment and the stationary cutting segment 10' with a piece of material M to be shared constrained by the shoulder and stepback in accordance with an embodiment of the invention.

FIG. 6 is a partial perspective view that illustrates the interaction of a rotary segment 40 and the stationary cutting segment 10' with a piece of material M to be sheared constrained by the first shoulder surface 16 of the stationary cutting segment 10' and stepback 24. The present invention is further detailed with respect to the following non-limiting examples.

EXAMPLES

Comparative Example A

A two-stage rotary granulator (Model 1013, Size Reduction Specialists, East Lansing, Mich., USA) has an upper stage stationary segment as depicted in FIGS. 1A and 1B and is operated without modification with a hopper filled with thermoplastic injection molding waste of sprues and runners. A throughput of 12 kilograms of 6 mm pellets is obtained per hour.

Example 1

The two-stage rotary granulator of the Comparative example is modified to replace the upper stage stationary segment with a unified stationary segment depicted in FIGS. 2A and 2B (2 mm setback and 10 mm shoulder height) and operated at the same speed and with the same material feedstock. A 33% increase in throughput is noted with no change in the quality of the resultant pellets relative to the Comparative example A.

Example 2

The process of Example 1 is repeated with a retrofit piece mounted over the first stage stationary segment of the Comparative example A with the same throughput as in Example 1.

Example 3

The process of Example 1 is repeated with a unified upper stage stationary segment having a setback of zero millimeters. A 31% increase in throughput is noted with no change in the quality of the resultant pellets relative to the Comparative example A.

Example 4

The process of Example 1 is repeated with a unified upper stage stationary segment having an angle $\delta$ of 30° and a sharpened shoulder edge. A 35% increase in throughput is noted with no change in the quality of the resultant pellets relative to the Comparative example A.

Example 5

The process of Example 1 is repeated with a unified upper stage stationary segment of Example 1 with the exception of a 5 mm shoulder height. A 28% increase in throughput is noted with no change in the quality of the resultant pellets relative to the Comparative example A.

Comparative Example B

The process of Example 1 is repeated with a unified upper stage stationary segment of Example 1 with the exception of a 20 mm shoulder height. No increase in throughput is noted with no change in the quality of the resultant pellets relative to the Comparative example A.

Although the present invention has been described with reference to preferred embodiments, numerous modifications and variations can be made and still the result will come within the scope of the invention. No limitation with respect to the specific embodiments disclosed herein is intended or should be inferred. Patents mentioned herein are hereby incorporated by reference to the same extent as if each was explicitly and individually incorporated by reference.

The invention claimed is:

1. A plastic granulator stationary cutting segment comprising:

a segment rail having a plurality of arcuate spaced teeth, each of said plurality of arcuate spaced teeth defining a tooth surface; and a shoulder having a first shoulder surface that extends away from each said tooth surface of said rail segment, and a second shoulder surface that intersects said first shoulder surface at a point that defines an edge, said edge has one or more V-shaped grooves or scallops between adjacent teeth of said plurality of arcuate spaced teeth, said second shoulder surface is parallel to and non-coplanar with the tooth surface where both said second shoulder surface and said tooth surface have a slope gamma (λ) of between 20° and 40° relative to an axis B-B that is perpendicular to a mounting base of said rail segment, said first shoulder surface being adjacent to each of said plurality of arcuate spaced teeth, said first shoulder surface having a height h of between 1 and 10 mm measured from the tooth surface to the second shoulder surface, and a stepback distance m of between 1 and 2 mm, said first shoulder surface and the tooth surface define an angle a therebetween of between 90° and 130° , said first shoulder surface having a rearward angle delta (δ) of between 20° and 40° relative to an axis A-A that is parallel to the mounting base.

2. The plastic granulator of claim 1 wherein said shoulder is unitary with said segment rail.

3. The plastic granulator of claim 1 wherein said shoulder is a separate piece joined to said segment rail.

4. The plastic granulator of claim 3 wherein said separate piece is formed of steel and said segment rail is form of steel.

5. The plastic granulator of claim 1 wherein the angle α between said first shoulder surface and the tooth surface is between 90° and 110° .

6. The plastic granulator of claim 1 wherein the rearward angle δ is 30° .

7. The plastic granulator of claim 1 wherein the edge is sharpened.

8. A method of granulating plastic material comprising:

rotating a rotary cutter against the stationary cutting segment of claim 1; and feed the plastic material into simultaneous contact between said rotary cutter and said stationary cutting segment to granulate the plastic material.

9. The method of claim 8 wherein the plastic material is a thermoplastic.

10. The method of claim 8 wherein the plastic material is in the shape of a sprue or a runner or a combination thereof.

11. The method of claim 10 wherein the plastic material is sheared between said rotary cutter and the edge of said stationary cutting segment.

* * * * *